US007884272B2

(12) United States Patent
Abe

(10) Patent No.: US 7,884,272 B2
(45) Date of Patent: Feb. 8, 2011

(54) SNARE STRAINER HAVING A MAGNETIC HOLDING MEMBER

(75) Inventor: Banri Abe, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 240 days.

(21) Appl. No.: 11/940,107

(22) Filed: Nov. 14, 2007

(65) Prior Publication Data

US 2008/0115652 A1 May 22, 2008

(30) Foreign Application Priority Data

Nov. 16, 2006 (JP) ..... 2006-310418

(51) Int. Cl.
*G10D 13/02* (2006.01)

(52) U.S. Cl. ..... 84/415; 84/416; 84/411 R

(58) Field of Classification Search ..... 84/415
See application file for complete search history.

(56) References Cited

U.S. PATENT DOCUMENTS 5,275,081 A * 1/1994 Freer ..... 84/415
5,844,157 A 12/1998 Kasha
6,008,445 A 12/1999 Chen et al.
2005/0223874 A1* 10/2005 Scott ..... 84/415
2005/0223875 A1* 10/2005 Hagiwara et al. ..... 84/415

FOREIGN PATENT DOCUMENTS

JP 58-50372 11/1983
JP 2005202063 7/2005

OTHER PUBLICATIONS

Japanese Patent Office Action, dated Nov. 18, 2008, counterpart application JP 2006-310418, and English translation thereof.

* cited by examiner

*Primary Examiner*—Elvin G Enad
*Assistant Examiner*—Christopher Uhlir
(74) *Attorney, Agent, or Firm*—Dickstein Shapiro LLP

(57) ABSTRACT

A snare strainer adapted to a snare drum is equipped with two strainers, which are attached to the opposite positions on the circumferential exterior of a cylinder of the snare drum and which control a snappy member to be selectively brought into contact with or separated from the backside head opposite to the drumhead. Herein, a moving base vertically moves along a fixed base attached to the circumferential exterior of the cylinder; holding members, which are tightly joined together so as to hold the terminal of the snappy member, are supported by a support member fixed to the moving base. The holding members are engaged with the support member due to a magnetic attraction exerted by permanent magnets. This makes it possible for the person to detachably attach the holding members to the support member without using tools; hence, it is possible to improve the handling of the snare strainer.

1 Claim, 4 Drawing Sheets

SNARE STRAINER HAVING A MAGNETIC HOLDING MEMBER

BACKGROUND OF THE INVENTION

1. Field of the Invention

The present invention relates to snare strainers, which control snappy members to be selectively brought into contact with or separated from drumheads and/or backsides of snare drums.

This application claims priority on Japanese Patent Application No. 2006-310418, the content of which is incorporated herein by reference.

2. Description of the Related Art

Snare drums are used to realize special sound effects called tambourine effects, the technologies of which are disclosed in various documents such as Japanese Examined Utility Model Publication No. S58-50372, U.S. Pat. No. 6,008,445, U.S. Pat. No. 5,844,157, and Japanese Unexamined Patent Application Publication No. 2005-202063. Snare drums are equipped with snare strainers for controlling snappy members (each constituted of thin wires, i.e., snares) to be brought into contact with or separated from either drumheads (i.e., striking sides of snare drums) or backside heads, or they are equipped with snare strainers for controlling snappy members to be selectively brought into contact with or separated from both of drumheads and backside heads, whereby vibrations of drumheads are transmitted to snares so as to produce rattling light tone colors of drum sounds.

FIG. 5 is a perspective view showing the exterior appearance of a conventionally-known snare drum, in which a snappy member is attached to a backside head positioned opposite to a drumhead (i.e., a striking side of the snare drum). FIG. 6 is an exploded perspective view showing a method of how to attach a snappy member to a snare strainer. Specifically, reference numeral 1 designates a snare drum; reference numeral 2 designates a cylindrical body (i.e., a cylinder), both ends of which are opened; reference numeral 3 designates a backside head covering the backside opening of the cylinder 2; reference numerals 4 designate hoops (or clamp frames) engaged with the openings of the cylinder 2; reference numerals 5 designate lugs; reference numerals 6 designate bolts for tightening and interconnecting the hoops 4 and the lugs 5 together; reference numeral 7 designates a snappy member attached to the backside head 3 of the snare drum 1; reference numeral 8 designates a first strainer for holding a moving terminal 7A of the snappy member 7; and reference numeral 9 designates a second strainer for holding a fixed terminal 7B of the snappy member 7. That is, a snare strainer adapted to the snappy member 7 is constituted of the first strainer 8 and the second strainer 9.

The snappy member 7 is constituted of a plurality of snares 11, which are laid in parallel with each other in a direction perpendicular to the longitudinal direction thereof with prescribed distances therebetween, a pair of snappy plates 12A and 12B, to which both ends of the snares 11 are fixed via solder or adhesive, and a pair of interconnection members 13A and 13B (FIG. 5 does not illustrate 13B) having flexibilities and attached to the snappy plates 12A and 12B. The interconnection member 13A (whose constitution is substantially identical to the constitution of the interconnection member 13B) is tightly held by means of a first holding member 14A and a second holding member 14B, which are detachably attached to the first snare strainer 8.

The first strainer 8 controls the moving terminal 7A of the snappy member 7 to be selectively brought into contact with or separated from the backside head 3 of the snare drum 1.

The first strainer 8 is constituted of the holding members 14A and 14B, a fixed base 15 fixed to the circumferential exterior of the cylinder 2, a moving base 16, which is freely movable in directions A and B, in other words, which is freely movable so that the snappy member 7 is brought into contact with or separated from the backside head 3, a switch mechanism 17, which controls the moving base 16 to be vertically moved relative to the fixed base 15 by way of a manual operation of a lever 17A so that the moving terminal 7A of the snappy member 7 is selectively brought into contact with or separated from the backside head 3, and a tension adjustment screw 18, which controls the moving base 16 to be vertically moved relative to the fixed base 15 so as to adjust a tension of the snappy member 7. The holding members 14A and 14B are fixed to the lower end portion of the moving base 16 via two square-headed bolts 19 in such a way that they tightly hold the interconnection member 13A.

The second strainer 9 differs from the first strainer 8 in that it is not equipped with a mechanism allowing the fixed terminal 7B of the snappy member 7 to be selectively brought into contact with or separated from the backside head 3 and a device for adjusting the tension of the snappy member 7. That is, the second strainer 9 is simply constituted of a fixed base (not shown) fixed to the circumferential exterior of the cylinder 2 and a pair of holding members (not shown) for holding the interconnection member 13B attached to the fixed terminal 7B of the snappy member 7.

When the snare drum 1 whose snare strainer is constituted of the first strainer 8 and the second strainer 9 is played without using the snappy member 7, the lever 17A of the switch mechanism 17 is manually rotated by a predetermined angle. When the lever 17A is rotated, the moving base 16 moves downwardly along the fixed base 15 so as to pull down the moving terminal 7A of the snappy member 7, thus releasing the snappy member 7 from the tensile condition (or stretched condition). At this time, the snappy member 7 is partially hung down due to its own weight and is separated from the backside head 3. This realizes a non-snappy mode allowing the snare drum 1 to be played without using the snappy member 7.

When the lever 17A, which is once set to the non-snappy mode, is moved oppositely by a prescribed angle to restore the original position thereof, the moving base 16 is lifted up to the original height so that the snappy member 7 is placed in the tensile condition and is brought into contact with the backside head 3. That is, the snare drum 1 is changed over from the non-snappy mode to the snappy mode using the snappy member 7. When the drumhead of the snare drum 1 is struck with a stick (or sticks) in the snappy mode, the vibration of the drumhead is transmitted to the snares 11 via the backside head 3. Thus, it is possible to realize the aforementioned special sound effect in which the drumhead and the backside head 3 of the snare drum 1 vibrate together with the snares 11 so as to produce the rattling light tone color.

In order to replace the backside head 3 with another head, the snare drum 1 is subjected to prescribed procedures, in which the bolts 19 are loosened so as to allow the snappy member 7 to be detached from the snare strainer of the snare drum 1; then, the bolts 6 are released from the lugs 5 so as to allow the hoops 4 to be detached from the cylinder 2; thereafter, the backside head 3 is replaced with another head. After completion of the replacement, the snappy member 7 is attached again to the snare drum 1 in accordance with procedures opposite to the aforementioned procedures.

According to the aforementioned fixing structure for fixing the snappy member 7 to the first strainer 8 (whose constitution is similar to the constitution of the second strainer 9), the interconnection member 13A interconnected to the moving terminal 7A of the snappy member 7 is tightly held between the holding members 14A and 14B, which are then fixed to the lower end portion of the moving base 16 (or the fixed based in the case of the second strainer 9) via the two square-headed bolts 19 by use of a drum key or wrench. For this reason, when the snappy member 7 is replaced with another type of snappy member, or when the backside head 3 is replaced with another head, it is necessary for a person to manually loosen the two square-headed bolts 19 so as to remove the snappy member 7 from the snare strainer of the snare drum 1. After completion of the replacement, it is necessary for the person to tightly hold the interconnection member 13A between the holding members 14A and 14B, which are then fixed to the moving base 16 via the square-headed bolts 19. This is a very troublesome operation.

When the interconnection member 13A is tightly held between the holding members 14A and 14B again so that the holding position thereof is unexpectedly changed, it is necessary for the person to readjust the tension of the snappy member 7 by use of the tension adjustment screw 18. It takes a relatively long time for the person to replace the backside head 3 with another head.

Japanese Unexamined Patent Application Publication No. 2005-202063 discloses a technology realizing a solution to the aforementioned problem, wherein it teaches a snare strainer including first and second holding members for tightly holding a snappy member, and wherein the first holding member is fixed to a moving base via a single bolt. This allows the person to fix the first holding member to the moving base by use of a single bolt, whereby it is possible to reduce the working time for attaching and removing the snappy member by means of the snare strainer compared with the conventionally-known snare strainer shown in FIGS. 5 and 6.

In addition, the aforementioned technology allows the person to remove the first and second holding members still tightly holding the interconnection member from the moving base. This eliminates the necessity of removing the interconnection member from the first and second holding members during the replacement of the backside head; and it is unnecessary to readjust the tension of the snappy member.

However, the aforementioned technology still requires a bolt, which is troublesome for the person to tighten and loosen. That is, the aforementioned technology does not realize an advantage over the conventionally-known snare strainer because it is still troublesome for the person to tighten and loosen the bolt. Therefore, it is strongly demanded to further improve the replacement work of snappy members and to further improve the handling of snare strainers.

SUMMARY OF THE INVENTION

It is an object of the present invention to provide a snare strainer, to which a snappy member is fixed without using a bolt so as to improve the replacement work therewith and to improve the handling thereof.

In a first aspect of the present invention, a snare strainer adapted to a snare drum includes a first strainer and a second strainer, each of which further includes a pair of holding members, which are tightly joined together, so as to hold a first interconnection member having flexibility and attached to the moving terminal of a snappy member, which is arranged in proximity to the backside head opposite to the drumhead of the snare drum, and a support member for supporting the holding members at a first position on the circumferential exterior of a cylinder of the snare drum. At least one of the first strainer and the second strainer includes at least one permanent magnet so that the holding members thereof are fixed to the support member thereof due to a magnetic attraction exerted by the permanent magnet, so that the snappy member is controlled to be brought into contact with or separated from the backside head of the snare drum.

In the above, one of the holding members and the support member is composed of a magnetic material, while the other is equipped with the permanent magnet. Alternatively, one of the holding members and the support member is composed of a magnetic material, while the other is formed using the permanent magnet.

In a second aspect of the present invention, a snare strainer adapted to a snare drum includes the first strainer and the second strainer, at least one of which further includes an engagement element, which is elastically deformable and which allows the holding members thereof to be detachably attached to the support member, so that the snappy member is controlled to be brought into contact with or separated from the backside head of the snare drum.

In a third aspect of the present invention, in at least one of the first strainer and the second strainer, the holding members thereof are detachably attached to the support member by way of engagement realized by at least one recess and at least one projection, so that the snappy member is controlled to be brought into contact with or separated from the backside head of the snare drum.

As described above, the holding members are fixed to the support member by use of the permanent magnet or the engagement element or by way of the engagement realized by the recess and projection. This makes it possible for the person to detachably attach the holding members to the support member with ease and without using tools such as bolts and a wrench. Thus, it is possible to simplify the replacement of the snappy member and backside head, and it is possible to improve the handling of the snare strainer.

As the magnetic material, it is preferable to use a ferromagnetic material whose relative magnetic permeability (μs) is much higher than "1". As the ferromagnetic material, it is possible to list iron (whose μs ranges from 100 to 10000), nickel (where μs=180), cobalt (where μs=270), and manganese (where μs=4000) as well as compounds of these materials.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENT

The present invention will be described in further detail by way of examples with reference to the accompanying drawings.

Figure 1:
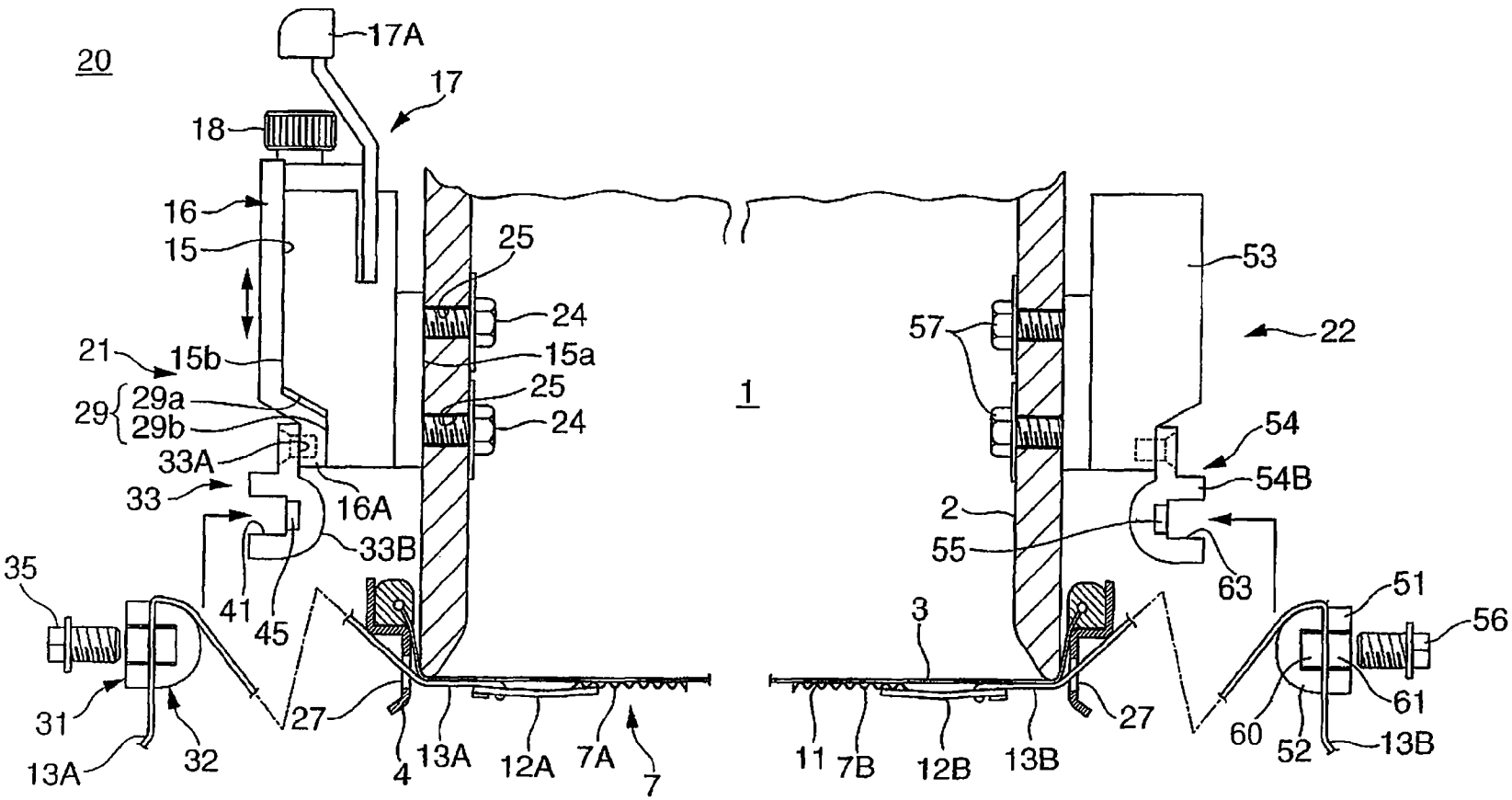
FIG. 1 is a longitudinal sectional view showing the constitution of a snare drum equipped with a snare strainer including first and second strainers in accordance with a preferred embodiment of the present invention.
Figure 2:
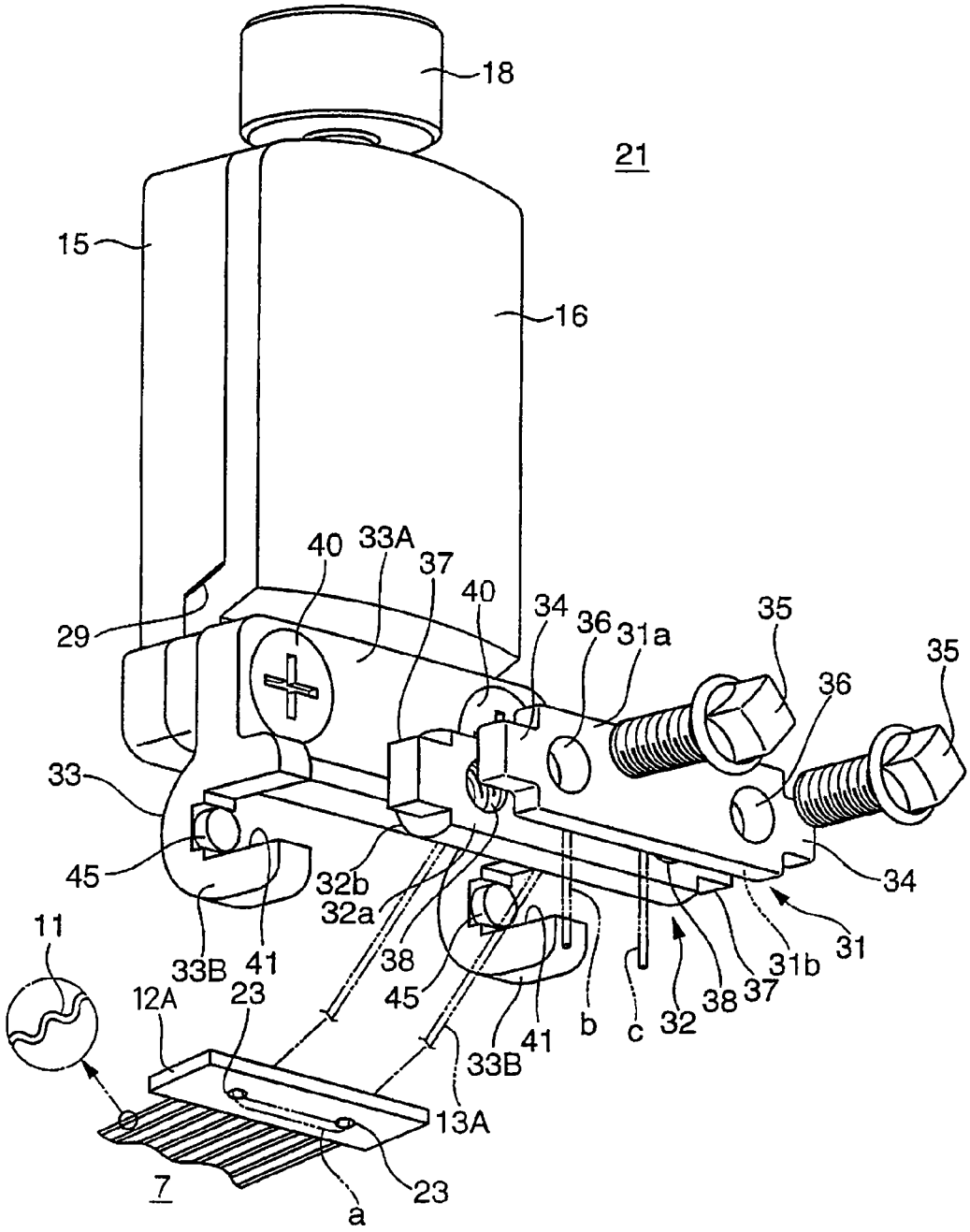
FIG. 2 is an exploded perspective view showing the constitution of the first strainer included in the snare strainer shown in FIG. 1.

FIG. 1 is a longitudinal sectional view showing the constitution of a snare drum 1 equipped with a snare strainer 20 including a first strainer 21 and a second strainer 22 in accordance with a preferred embodiment of the present invention. FIG. 2 is an exploded perspective view showing the essential parts of the first strainer 21. In FIGS. 1 and 2, the parts identical to those shown in FIGS. 5 and 6 are designated by the same reference numerals; hence, duplicate description thereof is omitted as necessary.

The snare drum 1 is equipped with the snare strainer 20, which controls the snappy member 7 to be selectively brought into contact with or separated from the backside head 3. The snare strainer 20 includes the first strainer 21 and the second strainer 22, both of which are attached to the circumferential exterior of the cylinder 2 of the snare drum 1 in proximity to the opening arranging the backside head 3 and which are distanced from each other with an angle of 180° therebetween in the circumferential direction of the cylinder 2.

Figure 5:
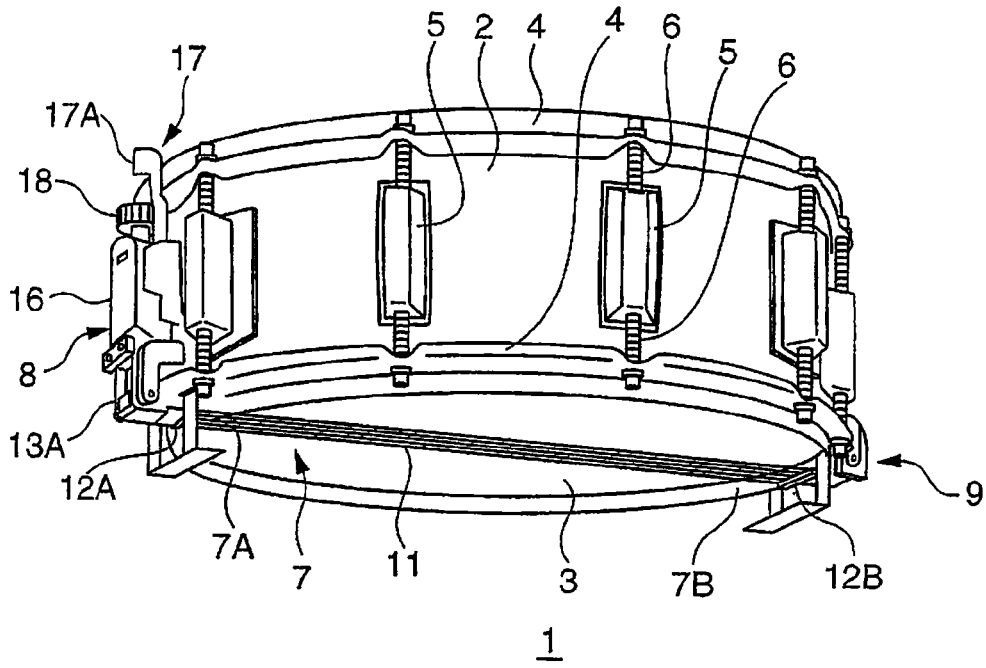
FIG. 5 is a perspective view showing an exterior appearance of a conventionally-known snare drum.
Figure 6:
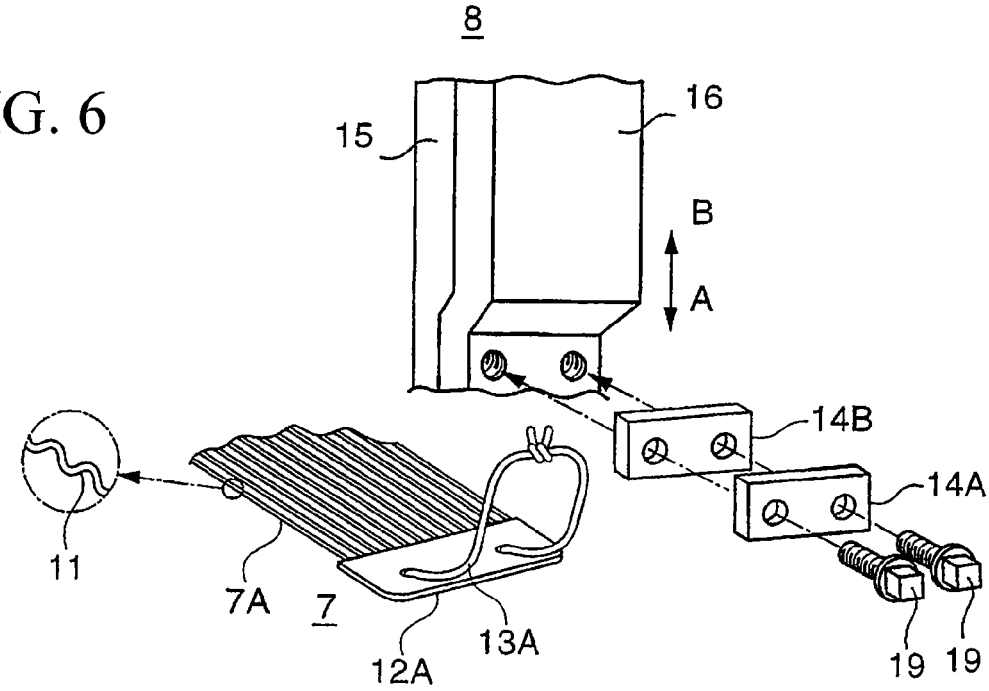
FIG. 6 is an exploded perspective view showing a fixing structure for fixing a snappy member to the snare strainer shown in FIG. 5.

The structure of the snappy member 7 is substantially identical to the structure of the conventionally-known snappy member shown in FIGS. 5 and 6. Specifically, the snappy member 7 is constituted of a plurality of thin wires (i.e., the snares) 11, which are arranged in parallel with each other with prescribed distances therebetween in the direction perpendicular to the longitudinal direction, a pair of the snappy plates 12A and 12B, to which terminals of the snares 11 are fixed with solder or adhesive, and a pair of the interconnection members 13A and 13B, both having flexibility, which are attached to the snappy plates 12A and 12B. The interconnection members 13A and 13B are each formed using thin strings or tapes having appropriate lengths. With respect to the interconnection member 13A that is engaged with the snappy plate 12A and the first strainer 21 as shown in FIG. 2, a center portion "a" (which is measured in the longitudinal direction of the interconnection member 13A) is inserted into holes 23 that are formed at both ends of the snappy plate 12A and is thus fixedly held by the snappy plate 12A. Similarly, the interconnection member 13B is engaged with the snappy plate 12B and the second strainer 22. The snappy member 7 is stretched under tension and is laid across the center of the backside head 3 in the radial direction, so that the snappy plates 12A and 12B are each brought into contact with the peripheral end portion of the backside head 3. The interconnection members 13A and 13B are pulled upwardly through openings 27 of the hoop (or clamp frame) 4 and are thus interconnected to the first strainer 21 and the second strainer 22.

The first strainer 21 controls the moving terminal 7A of the snappy member 7 to be selectively brought into contact with or separated from the backside head 3. The first strainer 21 includes the fixed base 15 that is fixed to the lower portion of the circumferential exterior of the cylinder 2 by use of bolts 24 and nuts (not shown).

The fixed base 15 has a hollow rectangular parallelepiped shape, which is composed of a synthetic resin. The nuts (not shown) are embedded in a backside 15*a* of the fixed base 15, which is closely attached to the circumferential exterior of the cylinder 2. The bolts 24 are inserted into holes 25, which are formed at prescribed positions to run through the circumferential exterior of the cylinder 2, and are then engaged with the nuts embedded in the backside 15*a* of the fixed base 15; thus, the fixed base 15 is fixed to the circumferential exterior of the cylinder 2. A front surface 15*b* of the fixed base 15 forms a slider for the moving base 16, wherein a step portion 29 is formed in the lower end thereof in proximity to the backside head 3. The step portion 29 has a stopper surface 29*a* for limiting the upward movement of the moving base 16 and a sliding surface 29*b* for guiding the lower end portion of the moving base 16. The sliding surface 29*b* is formed in parallel with the front surface 15*b* of the fixed base 15 and is inwardly recessed toward the circumferential exterior of the cylinder 2, so that the lower end portion of the fixed base 15 is reduced in thickness compared with the upper end portion thereof.

The moving base 16 is composed of a metal plate. A bent portion 16A roughly having a L-shape, which substantially matches the shape of the step portion 29 of the fixed base 15 in side view, is formed in the lower end portion of the moving base 16. In addition, the moving base 16 is interconnected to the switch mechanism 17 and the tension adjustment screw 18, which are partially embedded in the fixed base 15.

When the snappy member 7 is brought into contact with or separated from the backside head 3, the switch mechanism 17 operates to realize vertically linear movement of the moving base 16, wherein the moving base 16 moves along the front surface 15*b* of the fixed base 15 in the vertical direction (designated by arrows A and B) so that the snappy member 7 is brought into contact with or separated from the backside head 3. As the switch mechanism 17, it is possible to use any types of conventionally-known structures realizing the vertically linear movement or rotation with respect to the moving base 16. For example, it is possible to use a cam, a link, and a lever (not shown). In this case, the switch mechanism 17 employs the structure substantially identical to the structure of the switch mechanism taught in Japanese Unexamined Patent Application Publication No. 2005-202063, wherein it is constituted of a link and the lever 17A. For the sake of convenience, the structure of the switch mechanism 17 is not illustrated or described in detail.

The tension adjustment screw 18 has the structure substantially identical to the structure of the tension adjustment screw taught in Japanese Unexamined Patent Application Publication No. 2005-202063, wherein it is attached to the upper surface of the fixed base 15 in a free-rotation manner. The tension adjustment screw 18 is manually rotated so as to move a nut (not shown, but which is engaged with the tension adjustment screw 18) upwardly or downwardly while applying pressure to the moving base 16, which is thus moved upwardly or downwardly.

In addition to the fixed base 15, the switch mechanism 17 including the lever 17A, and the moving base 16, the first strainer 21 further includes a pair of a first holding member 31 and a second holding member 32, which are combined together so as to tightly hold the terminal portion of the interconnection member 13A (which is interconnected to the moving terminal 7A of the snappy member 7) therebetween, and a support member 33 for holding the first holding member 31 and the second holding member 32.

The first holding member 31 having a front surface 31*a* and a backside 31*b*, both of which are planar in shape, is formed using a thin metal plate composed of a prescribed metal such as aluminum. The first holding member 31 has two projected portions 34, which are integrally formed therewith at both ends thereof in the longitudinal direction. Each of the projected portions 34 has a rectangular shape in plan view, the width of which is smaller than the width of the center portion of the first holding member 31. In addition, two holes 36 allowing two square-headed bolts 35 to be inserted therein are formed at both ends of the first holding member 31.

The second holding member 32 is formed in a rod-like shape having a D-shaped cross section, wherein a planar front surface 32*a* thereof is positioned directly opposite to the backside 31*b* of the first holding member 31 and wherein a backside 32*b* thereof has a circularly curved surface. Both of terminal portions "b" and "c" of the interconnection member 13A are tightly held between the backside 31*b* of the first holding member 31 and the front surface 32*a* of the second holding member 32. The second holding member 32 is shaped substantially similar to the first holding member 31. Therefore, the length of the second holding member 32 substantially matches the length of the first holding member 31 in the longitudinal direction, wherein, similar to the first holding member 31, two projected portions 37 each having a rectangular shape in plan view integrally project from both ends of the second holding member 32. In addition, two internally-threaded holes 38 allowing the bolts 35 to be inserted into and engaged with are formed at both ends of the second holding member 32.

The second holding member 32 is composed of a magnetic material, preferably, a ferromagnetic material whose relative magnetic permeability (μs) is much higher than "1". Iron (whose μs ranges from 100 to 10000) can be used as the ferromagnetic material because it is inexpensive and easily available although it is possible to use other materials such as nickel (where μs=180), manganese (where μs=4000), and cobalt (where μs=270) as well as compounds of these materials.

The terminal portions b and c of the interconnection member 13A are pulled upwardly along the backside 32*b* from the lower portion to the upper portion of the second holding member 32 so as to partially join the backside 32*b*; then, the upper ends of the terminal portions b and c are folded and pulled downwardly along the front surface 32*a* of the second holding member 32. Then, the first holding member 31 and the second holding member 32 are tightly joined together by use of the two bolts 35, which are inserted into the holes 36 of the first holding member 31 and are then further inserted into and engaged with the internally-threaded holes 38 of the second holding member 32, so that the terminal portions b and c of the interconnection member 13A are tightly held between the first holding member 31 and the second holding member 32. When the first holding member 31 and the second holding member 32 are tightly joined together by means of the bolts 35, the projected portions 34 of the first holding member 31 overlap with the projected portions 37 of the second holding member 32 in plan view.

The support member 33 is a molding composed of aluminum, wherein it is constituted of a base 33A having a thin plate-like shape and a pair of supports 33B, which integrally join both ends of the base 33A. The base 33A of the support member 33 is fixed to the front surface of the bent portion 16A by means of two screws 40. Each of the supports 33B is formed in a U-shape in side view, which provides a rectangular channel 41 whose opening is directed opposite to the circumferential exterior of the cylinder 2. The channels 41 of the supports 33B have the same width that is slightly larger than the widths of the projected portions 34 and 37, and they have the same depth that is substantially identical to the overall thickness of the projected portions 34 and 37 tightly joining together. In addition, permanent magnets 45 are attached to the bottoms of the U-shaped channels 41. Each of the permanent magnets 45 is formed in a disk-like shape whose surfaces are magnetized in N and S polarities, one of which comes in contact with the backside 32*b* of the second holding member 32.

The first holding member 31 and the second holding member 32, which are tightly joined together by means of the bolts 35, are supported by the support member 33 in such a way that the projected portions 34 and 37 tightly joining together are engaged with the channels 41 of the supports 33B of the support member 33, wherein the projected portions 37 are engaged with the bottoms of the channels 41 rather than the projected portions 34. The first holding member 31 and the second holding member 32 are fixedly engaged with the channels 41 in such a way that the projected portions 37 of the second holding member 32 are magnetically attracted to the permanent magnets 45 attached to the bottoms of the channels 41, whereby it is possible to reliably prevent the first holding member 31 and the second holding member 32 from unexpectedly falling out of the channels 41.

In order to remove the first holding member 31 and the second holding member 32 from the support member 33, it is necessary for the person to manually hold and then extract them from the channels 41 against the magnetic attraction exerted by the permanent magnets 45.

The second strainer 22 is constituted of a pair of a first holding member 51 and a second holding member 52, which tightly hold the interconnection member 13B fixedly attached to the fixed terminal 7B of the snappy member 7, a fixed base 53 fixed to the circumferential exterior of the cylinder 2, a support member 54, which is fixed to the surface of the lower end portion of the fixed base 53 so as to support both ends of the first holding member 51 and both ends of the second holding member 52, and permanent magnets 55, which are attached to the support member 54 so as to fix the first holding member 51 and the second holding member 52 to the support member 54.

The first holding member 51 and the second holding member 52 included in the second strainer 22 are designed substantially identical to the first holding member 31 and the second holding member 32 included in the first strainer 21. They are tightly joined together by means of two bolts 56, thus tightly holding the terminal portions of the interconnection member 13B.

The fixed base 53 of the second strainer 22 is shaped identical to the fixed base 15 of the first strainer 21 in exterior appearance, wherein it is fixed to the circumferential exterior of the cylinder 2 by means of bolts 57. However, the second strainer 22 differs from the first strainer 21 in that it is not equipped with the moving base 16, the switch mechanism 17, the lever 17A, and the tension adjustment screw 18.

The support member 54 of the second strainer 22 is shaped identical to the support member 33 of the first strainer 21; hence, the description thereof is omitted. In addition, the permanent magnets 55 of the support member 54 are identical to the permanent magnets 45 of the support member 33.

The first holding member 51 and the second holding member 52, which are tightly joined together by means of the bolts 56, are supported by the support member 54 in such a way that projected portions 60 projected from both ends of the first holding member 51 and projected portions 61 projected from both ends of the second holding member 52 are engaged with channels 63 of supports 54B of the support member 54, wherein the projected portions 60 come in contact with the bottoms of the channels 63 rather than the projected portions 61. That is, the first holding member 51 and the second holding member 52 tightly joining together are supported by the support member 54 in such a way that the projected portions 60 of the second holding member 52 are magnetically attracted to the permanent magnets 55 attached to the bottoms of the channels 63 of the supports 54B of the support member 54, wherein it is possible to reliably prevent them from unexpectedly falling out of the channels 63 of the supports 54B of the support member 54.

In order to remove the first holding member 51 and the second holding member 52 from the support member 54, it is necessary for the person to manually hold and then extract them from the channels 63 against the magnetic attraction exerted by the permanent magnets 55.

According to the present embodiment, the first holding member 31 and the second holding member 32 of the first strainer 21 are supported by the supports 33B of the support member 33 and are fixedly attached to the support member 33 due to magnetic attraction exerted by the permanent magnets 45, while the first holding member 51 and the second holding member 52 of the second strainer 22 are supported by the supports 54B of the support member 54 and are fixedly attached to the support member 54 due to magnetic attraction exerted by the permanent magnets 55. This eliminates the necessity of using bolts in fixation; therefore, all the holding members 31, 32, 51, and 52 can be easily attached to and removed from the support members 33 and 54 without using tools. That is, it is possible to easily and rapidly exchange the snappy member 7 and the backside head 3 with new ones; hence, it is possible to improve the handling of the snare strainer 20.

When the backside head 3 is replaced with another head, it is simply required for the person to extract the holding members 31, 32, 51, and 52 from the support members 33 and 54, wherein it is unnecessary for the person to loosen the bolts 35 and 56 and to release the tightly held conditions of the interconnection members 13A and 13B. Therefore, when the snappy member 7 is attached again to the snare drum 1 after completion of the replacement of the backside head 3, it is unnecessary for the person to readjust the tension of the snares 11.

In addition, the terminal portions b and c of the interconnection member 13A are pulled downwardly from the upper portions to the lower portions of the holding members 31 and 32, while the terminal portions b and c of the interconnection member 13B are pulled downwardly from the upper portions to the lower portions of the holding members 51 and 52. This prevents the terminal portions b and c from unexpectedly coming in contact with hands to cause problems when the snare strainer 20 is manually operated.

Furthermore, the backsides of the second holding members 32 and 52 are formed in circular curved shapes, which the interconnection members 13A and 13B are partially brought into contact with. This appropriately disperses forces applied to the interconnection members 13A and 13B; hence, it is possible to prevent the interconnection members 13A and 13B from being unexpectedly broken.

Figure 3:
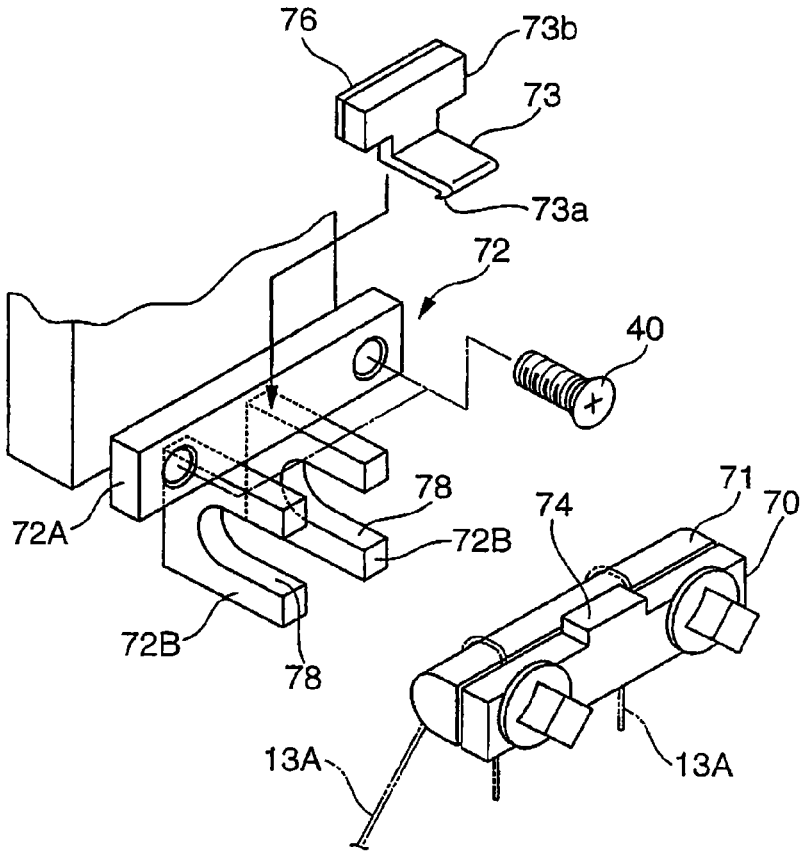
FIG. 3 is an exploded perspective view showing a first strainer included in a snare strainer adapted to the snare drum in accordance with a variation of the preferred embodiment.

The present embodiment can be modified in a variety of ways; FIG. 3 is an exploded perspective view showing the essential parts of a first strainer included in a snare strainer adapted to the snare drum 1 in accordance with a variation of the present embodiment; and FIG. 4 is a cross-sectional view of the first strainer shown in FIG. 3.

Figure 4:
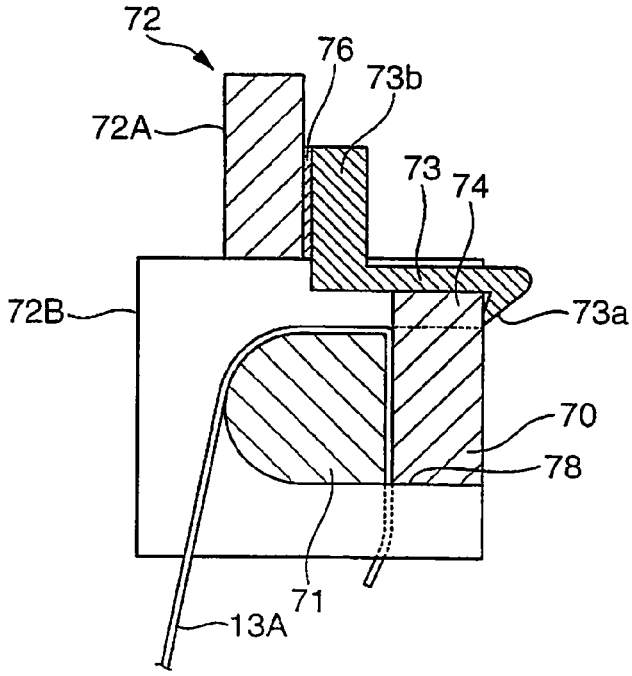
FIG. 4 is a cross-sectional view of the first strainer shown in FIG. 3.

Similar to the first strainer 21, the first strainer shown in FIGS. 3 and 4 includes a pair of a first holding member 70 and a second holding member 71 and a support member 72. This first strainer is characterized by using an engagement element 73, which is elastically deformable, instead of the permanent magnets 45.

The first holding member 70 differs from the first holding members 31 and 51 shown in FIGS. 1 and 2 in that it is integrally formed with a projection 74, which projects from the upper surface of the center portion thereof and which engages with a claw 73*a* of the engagement element 73, wherein no projected portions are formed on both ends thereof. Except for the aforementioned point, the first holding member 70 is designed similar to the first holding members 31 and 51. The second holding member 71 is composed of aluminum, wherein it differs from the second holding members 32 and 52 shown in FIGS. 1 and 2 in that no projected portions are formed on both ends thereof. Except for the aforementioned point, the second holding member 71 is designed similar to the second holding members 32 and 52.

The support member 72 is constituted of a base portion 72A having a plate-like shape and a pair of supports 72B for supporting the first holding member 70 and the second holding member 71. The supports 72B are integrally formed on the lower surface of the intermediate portion of the base portion 72A. Except for the aforementioned point, the support member 72 is designed similar to the support members 33 and 54 shown in FIGS. 1 and 2.

The engagement element 73 is designed such that a T-shaped fixing portion 73*b* integrally projects upwardly from a base portion having a plate-like shape. The fixing portion 73*b* is shaped thicker than the base portion of the engagement element 73, thus realizing a sufficiently high rigidity. The fixing portion 73*b* of the engagement element 73 is bridged between the supports 72B of the support member 72. In addition, the fixing portion 73*b* is fixedly adhered to the surface of the center portion of the base portion 72A of the support member 72 via a both-side adhesive tape 76, which is attached to the backside of the fixing portion 73*b*. Thus, the engagement element 73 is precisely positioned between the two supports 72B of the support member 72.

When the first holding member 70 and the second holding member 71, which are tightly joined together, are inserted into channels 78 of the supports 72B of the support member 72, the projection 74 of the first holding member 70 presses the claw 73*a* of the engagement element 73 upwardly, so that the engagement element 73 is elastically deformed upwards. When the first holding member 70 and the second holding member 71 are deeply inserted into and brought into contact with the bottoms of the channels 78 of the supports 72B, the projection 74 moves further deeply to pass the claw 73*a* under the engagement element 73, thus releasing a pressed condition of the engagement element 73 that is temporarily pressed upwardly by means of the projection 74. That is, the engagement element 73 is elastically restored so that the claw 73*a* is engaged with the front surface of the projection 74. Thus, the first holding member 70 and the second holding member 71 are fixedly attached to the support member 72, wherein it is possible to prevent them from unexpectedly falling out of the channels 78 of the supports 72B. In order to extract the first holding member 70 and the second holding member 71 from the support member 72, it is necessary for the person to press the claw 73*a* upwardly with a finger so as to elastically deform the engagement element 73, thus releasing an engaged condition of the engagement element 73, in which the claw 73*a* is engaged with the projection 74. In this state, the first holding member 70 and the second holding member 71 can be extracted from the channels of the supports 72B of the support member 72.

The aforementioned variation of the present embodiment shown in FIGS. 3 and 4 is designed such that the first holding member 70 and the second holding member 71 tightly joining together are inserted into the channels 78 of the supports 72B of the support member 72 and are fixed in position by means of the engagement element 73. This eliminates the necessity of using bolts for fixing them; and this makes it possible for the person to detachably attach the first holding member 70 and the second holding member 71 to the support member 72.

Since no permanent magnet is used, the second holding member 71 is not necessarily composed of a magnetic material. This raises the degree of freedom in selecting materials for use in the formation of the snare strainer.

The aforementioned variation refers to the first strainer that is interconnected to the moving terminal 7A of the snappy member 7. Of course, it can be applied to the second strainer that is interconnected to the fixed terminal 7B of the snappy member 7.

The present invention is not necessarily limited to the present embodiment and its variation; hence, it is possible to realize a variety of variations within the scope of the invention defined by the appended claims. For example, the positions of the permanent magnets 45 installed in the support member 33 (or the support member 54) are not necessarily limited to the foregoing positions; that is, the permanent magnets 45 are not necessarily attached to the bottoms of the channels 41; hence, they can be attached to the upper walls or lower walls of the channels 41. In addition, the permanent magnets 45 can be rearranged so as to magnetically attract the first holding member 31 instead of the second holding member 32, wherein the first holding member 31 should be composed of a magnetic material. Furthermore, the permanent magnets 45 can be rearranged so as to magnetically attract both of the first holding member 31 and the second holding member 32, both of which should be composed of a magnetic material.

It is possible to further modify the first strainer 21 in such a way that the permanent magnets 45 are attached to at least one of the first holding member 31 and the second holding member 32, and the support member 33 is composed of a magnetic material. Alternatively, at least one of the first holding member 31 and the second holding member 32 is formed using a permanent magnet material, and the support member 33 is composed of a magnetic material. Alternatively, at least one of the first holding member 31 and the second holding member 32 is formed using a magnetic material, and the support member 33 is composed of a permanent magnet material.

In the above, the snare strainer is designed to use the permanent magnets 45, 55, and the engagement element 73, which are not restrictions. For example, a pair of holding members (designated by reference numerals 31 and 32, reference numerals 51 and 52, or reference numerals 70 and 71) are detachably attached to the support member (designated by reference numeral 33, reference numeral 54, or reference numeral 72) by way of the engagement of recesses and projections. Specifically, the channels 41, 63, and 78 of the support members 33, 54, and 72 serve as the recesses, while the projected portions 34 of the first holding member 31, the projected portions 37 of the second holding member 32, and the terminal portions of the holding members 70 and 71 serve as the projections. Alternatively, the recesses are formed in the holding members, while the projections are formed in the support members.

The support members 33 and 54 are not necessarily produced as independent pieces. That is, they can be integrally formed together with the moving base 16 or the fixed based 15 and 53.

In the above, strings or wires are used as the flexible interconnection members 13A and 13B that are interconnected to the moving terminal 7A and the fixed terminal 7B of the snappy member 7. Of course, they are not restrictions; hence, it is possible to use belts as the interconnection members 13A and 13B.

The snare strainer can be equipped with a mechanism that allows the first strainer 21 and the second strainer 22 to control the moving terminal 7A and the fixed terminal 7B of the snappy member 7 to be brought into contact with or separated from the drumhead of the snare drum 1 instead of the backside head 3.

What is claimed is:

1. A snare strainer adapted to a snare drum comprising:

a first strainer including a first pair of holding members, which are tightly joined together, so as to hold a first interconnection member having a flexibility and attached to a moving terminal of a snappy member, which is arranged in proximity to a backside head opposite to a drumhead of the snare drum, and a first support member for supporting the first pair of holding members at a first position on a circumferential exterior of a cylinder of the snare drum; and a second strainer including a second pair of holding members, which are tightly joined together so as to hold a second interconnection member having a flexibility and attached to a fixed terminal of the snappy member, and a second support member for supporting the second pair of holding members at a second position, which is opposite to the first position, on the circumferential exterior of the cylinder of the snare drum, wherein at least one of the first strainer and the second strainer includes at least one permanent magnet so that the respective holding members thereof are fixed to the respective support member thereof due to a magnetic attraction exerted by the permanent magnet, wherein one of the holding members and the support member in the at least one of the first strainer and the second strainer is composed of a magnetic material, while the other is formed using the permanent magnet, whereby the snappy member is controlled to be brought into contact with or separated from the backside head of the snare drum.

* * * * *